United States Patent [19]

Jelinek

[11] Patent Number: 4,886,006

[45] Date of Patent: Dec. 12, 1989

[54] FABRIC EASING DRUM

[75] Inventor: Vaclav Jelinek, River Edge, N.J.

[73] Assignee: SSMC Inc., Fairfield, N.J.

[21] Appl. No.: 313,208

[22] Filed: Feb. 21, 1989

[51] Int. Cl.[4] ..... D05B 27/16

[52] U.S. Cl. ..... 112/313; 112/304

[58] Field of Search ..... 2/275; 112/262.1, 262.3, 112/121.11, 303, 304, 305, 306, 312, 313

[56] References Cited

U.S. PATENT DOCUMENTS

| | | | |
|---|---|---|---|
| 4,109,595 | 8/1978 | Ducol et al. | 112/121.11 |
| 4,292,908 | 10/1981 | Blessing | 112/312 X |
| 4,457,243 | 7/1984 | Bowditch | 112/304 X |
| 4,512,269 | 4/1985 | Bowditch | 112/304 X |
| 4,632,046 | 12/1986 | Barrett et al. | 112/304 X |
| 4,719,864 | 1/1988 | Barrett et al. | 112/304 X |

*Primary Examiner*—Werner H. Schroeder

*Assistant Examiner*—David K. Soto

*Attorney, Agent, or Firm*—Theodore C. Jay

[57] ABSTRACT

An easing drum has an elongated horizontal shaft having an elongated horizontal axis about which the shaft is rotatable. A plurality of like circular discs are secured at their centers to said shaft and are rotatable therewith. The discs are spaced apart and lie in parallel vertical planes, each disc having an external periphery covered with a high friction coating. A mechanism is connected to the shaft to rotate it. A horizontally elongated grating is disposed above the shaft. The grating has spaced openings, each opening being aligned with a portion of the external periphery of the corresponding disc. The shaft can be raised to a first position at which the portions of the peripheries extend through the grating openings and can be lowered to a second position at which the openings are spaced above these portions.

10 Claims, 4 Drawing Sheets

FABRIC EASING DRUM

BACKGROUND OF THE INVENTION

Easing is a technique employed in forming clothing having inner and outer layers such as trousers and sleeves in order to achieve fullness and body of the form. The outer layer is normally shorter than the inner layer, and the inner layer is mini-bunched through the entire length of easing such that both layers are aligned at their ends. The usual amount of easing is small, normally between 2% and 5%.

In the conventional process for sewing two layers together, the two layers are fed between upper and lower banks of endless belts to a sewing station, and the layers properly sewn together are removed from the sewing station by a take up bank of endless belts. Sometimes easing is not required, in which case the speeds of rotation of the belts in the two banks must be synchronized. When easing is required, the upper and lower banks must be operated at different speeds. The belts of one or both banks are covered with high friction material so that, during easing operation, one belt bank can engage the adjacent layer of fabric to control its rate of feed without controlling the rate of feed of the other layer.

The present invention is directed toward a new type of apparatus which can be used as a substitute for the lower bank of endless belts in the easing process described above. This new type of apparatus is much less expensive to produce and maintain, as compared to the costs of production and maintenance of the lower bank; its speed can be easily controlled to exceed that of the upper bank or to be less than that of the upper bank; and when easing processes are not used, no synchronization is required. This new type of apparatus employs no endless belts, but instead employs a plurality of rotating discs. Because of its appearance and function, the new type of apparatus is referred to herein as a fabric easing drum.

SUMMARY OF THE INVENTION

In accordance with the principles of the invention, a fabric easing drum employs an elongated horizontal shaft having an elongated horizontal axis about which said shaft is rotatable. A plurality of like circular discs cooperate with the shaft, each disc being secured at its center to the shaft and being rotatable therewith. The discs are spaced apart and lie in parallel vertical planes, each disc having an external periphery covered with a high friction coating. Suitable driving means coupled to the shaft rotates the shaft about its axis. This means is adjustable to vary the speed of rotation as desired.

A horizontally elongated grating is disposed above the shaft. The grating has spaced openings, each opening being aligned with a portion of the external periphery of a corresponding disc. The shaft has a first position at which these portions extend through the grating openings and a second position at which these portions are spaced from the openings. When the drum is used in an easing operation, the shaft is placed in its first position; the second position is employed when no easing operations are required. To this end, the shaft is disposed in a vertical plane disposed at right angles to the planes of the discs, the first position of the shaft being higher in said vertical plane than the second position. Shaft moving means coupled to opposite ends of the shaft enables the shaft to be raised or lowered as required.

In use the drum is used in place of the lower bank of endless belts. The grate provides support for the fabric and prevents it from becoming wrapped about the discs or otherwise impairing proper operation.

DETAILED DESCRIPTION OF PREFERRED EMBODIMENTS

Figure 1:
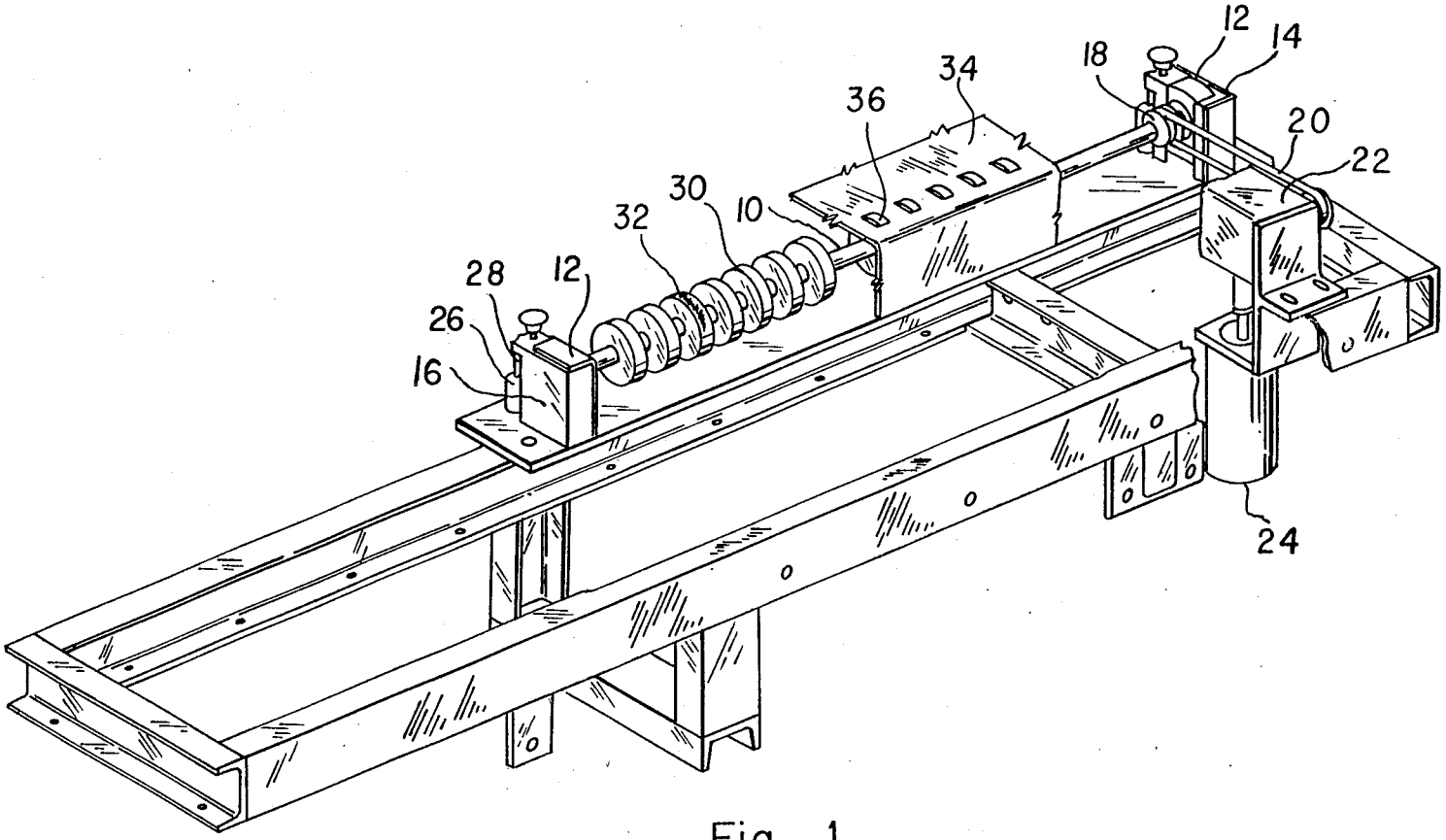
FIG. 1 is a partially cut away perspective view of the invention.

Referring first to FIG. 1, a horizontally elongated shaft 10 is rotatably disposed at each of its opposite ends in a corresponding pillow block 12. Each pillow block is vertically slidable up and down in a corresponding vertical groove 14 in a corresponding housing 16. A timing belt pulley 18 secured to the shaft adjacent one end and rotatable therewith is connected by a timing belt 20 to a worm gear reduction drive 22 operated by a servo motor 24. Two mini-pancake air cylinders 26 are provided. Each cylinder is secured to a corresponding housing and has a vertically disposed piston 28 secured to the corresponding pillow blocks 12. These two cylinders are actuated and deactuated in parallel by a solenoid. When the cylinders are actuated, their pistons are extended upwardly out of the cylinders, and the shaft is raised to a first upper position. When the cylinders are deactuated, their pistons are withdrawn into the cylinders and the shaft is lowered to a second lower position.

Each of a plurality of circular discs 30 is secured at its center to the shaft and rotates therewith. The discs are spaced apart and lie in vertical planes. The outer peripheral surface of each disc is coated as shown at 32 with a high friction coating. The purpose of this coating is to maximize its holding power of one layer of fabric while moving it against another. A grate 34 is spaced above the shaft. The grate has openings 36 therein which are alignable with selected peripheral portions of the underlying discs. When the shaft is in its first position, as used in easing operations, these portions extend through the openings and protrude somewhat (for example about $\frac{1}{8}$ inch) above the surface of the grate. When no easing is required, the shaft is placed in its second position, and these portions cannot extend above the surface of the grate.

Figure 2:
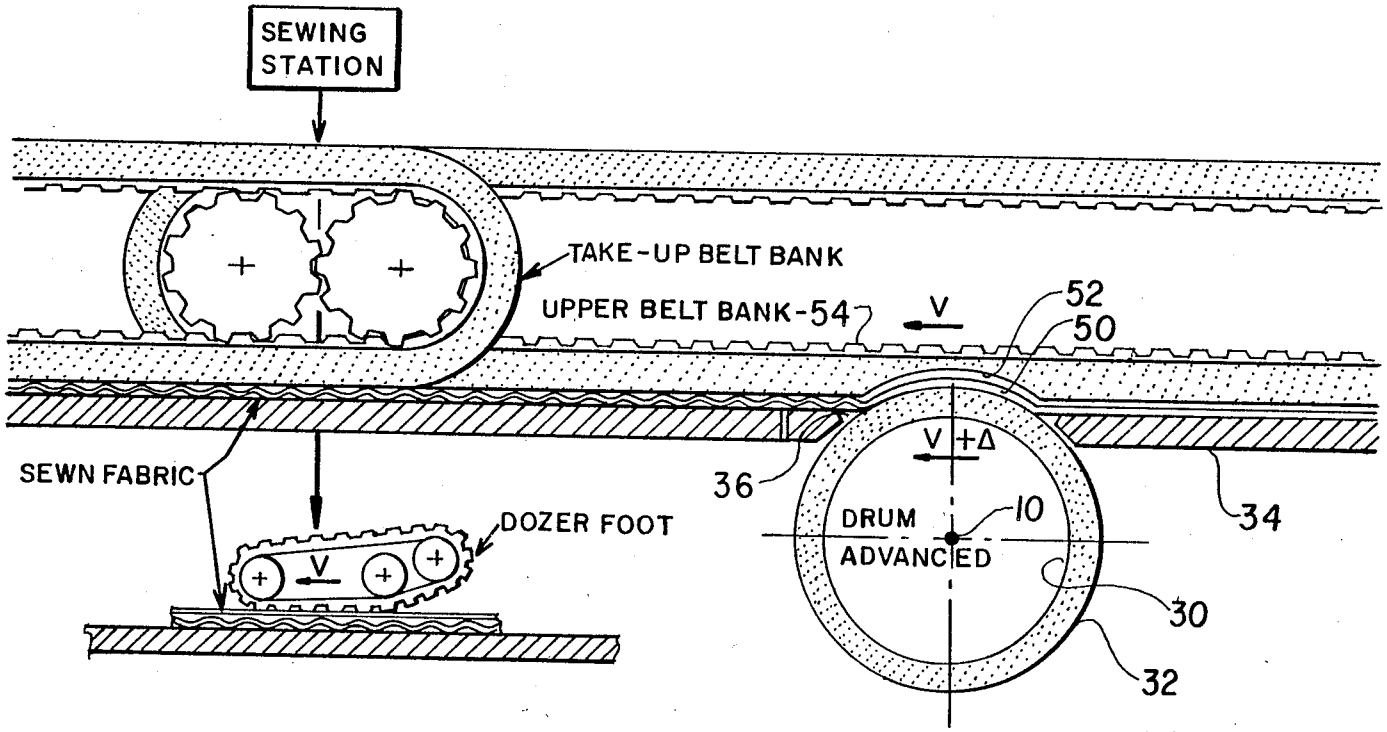
FIG. 2 is a diagram illustrating operation of the invention in an easing process wherein the lower of two fabric layers is to be eased.

FIG. 2 shown the structure of FIG. 1 as used in an easing operation wherein a lower layer 50 of fabric is to be eased with respect to an upper layer 52 of fabric. In this situation, the speed of rotation of the shaft 10 is higher than the speed of rotation of the upper bank of belts 54.

Figure 3:
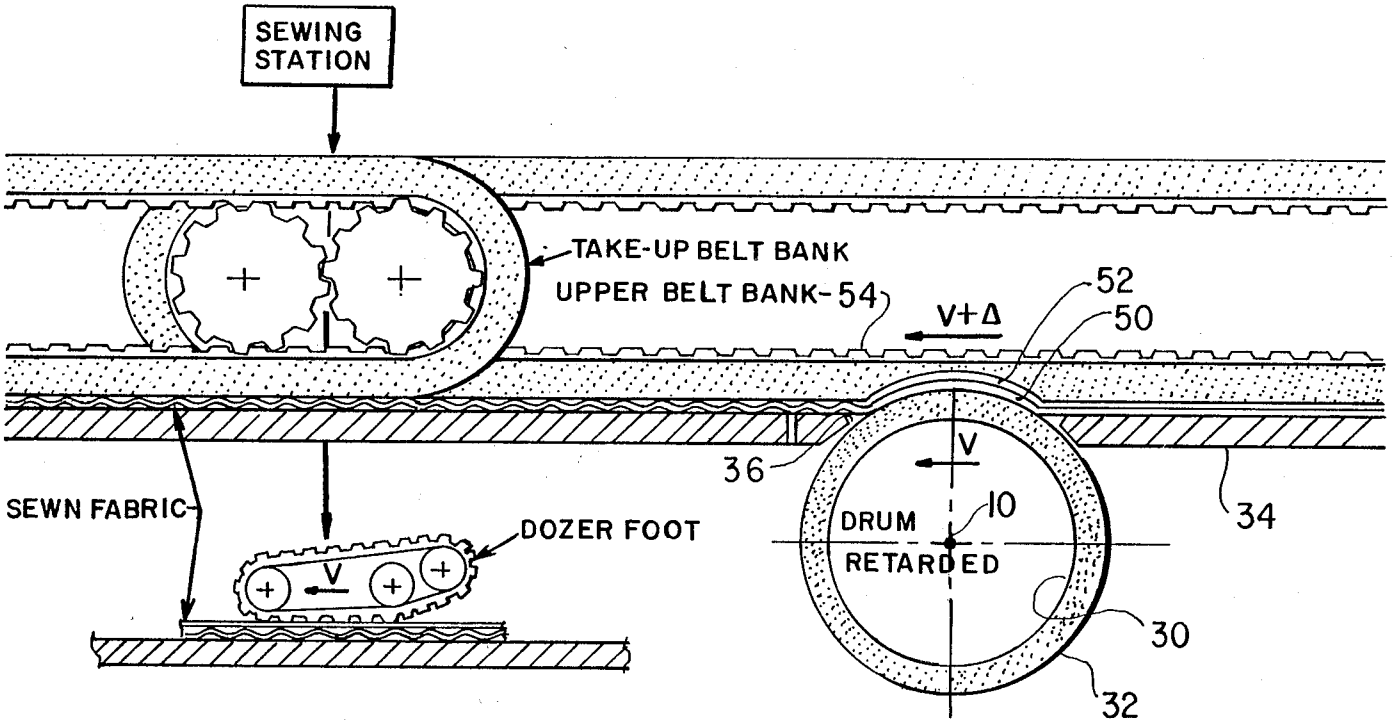
FIG. 3 is a diagram similar to that of FIG. 2 wherein the upper of two fabric layers is to be eased.

FIG. 3 shows the structure of FIG. 1 as used in an easing operation wherein the upper layer of fabric 52 is to be eased with respect to the lower layer 50 of fabric. In this situation, the speed of rotation of the shaft 10 is lower than the speed of rotation of the upper bank of belts 54.

Figure 4:
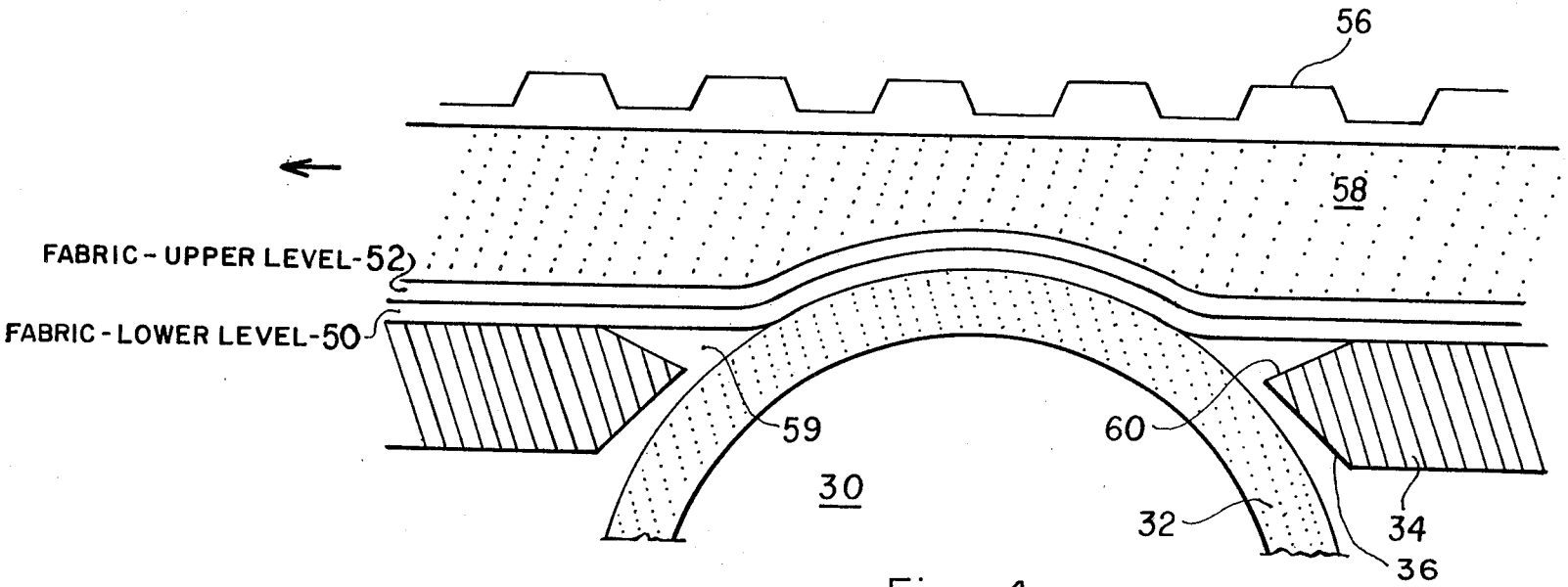
FIG. 4 is an enlarged detail view showing the relationship of one of the discs shown in FIG. 1 with respect to layers of fabric and a belt of the upper bank of belts when an easing operation is in progress.

FIG. 4 shows a disc 30 with coating 32 having a portion extending upward through and above an opening 36 in grate 34, with lower layer of fabric 50 and upper layer of fabric 52 and a belt 56 of upper bank of belts 54. In order to provide proper frictional relationships, belt 56 also has a high friction coating 58.

The grate openings each have two opposite downwardly and outwardly extending edges 59 and 60. The beveled edge 59, in the front, prevents fabric from being caught. The larger beveled edge 60, in the rear, functions as a fabric reservoir. It stores that portion of the fabric which forms a standing wave when the drum is rotated at a speed lower than that of the upper bank of belts.

What is claimed is:

1. A fabric easing drum comprising:

an elongated horizontal shaft having an elongated horizontal axis about which said shaft is rotatable;

a plurality of like circular discs secured at their centers to said shaft and rotatable therewith, said discs being spaced apart and lying in parallel vertical planes, each disc having an external periphery covered with a high friction coating; and driving means coupled to said shaft to rotate same about the axis.

2. The drum of claim 1 further including a horizontally elongated grating disposed above the shaft, said grating having spaced openings, each opening being aligned with a portion of the external periphery of the corresponding disc.

3. The drum of claim 2 wherein the openings have bevelled edges which extend downwardly and outwardly from the upper surface of the grate.

4. The drum of claim 3 wherein the shaft has a first position at which said portions extend through the grating openings and a second position at which said portions are spaced from the openings, said first position being employed in easing operations, said second position being employed when no easing operations are required.

5. The drum of claim 4 wherein the shaft is disposed in a vertical plane disposed at right angles to the planes of the discs, the first position of the shaft being higher in said vertical plane than the second position.

6. The drum of claim 5 further including shaft moving means coupled to opposite ends of the shaft to raise the shaft into the first position and to lower the shaft into the second position.

7. The drum of claim 6 wherein the shaft moving means includes two air cylinders, each cylinder being disposed at a corresponding one of the two opposite ends of the shaft.

8. The drum of claim 7 wherein each end of the shaft is disposed rotatably in a corresponding pillow block.

9. The drum of claim 8 wherein each pillow block is slidable up and down in a vertical groove in a corresponding block housing.

10. The drum of claim 9 wherein each cylinder has a vertically movable piston having raised and lowered positions which respectively determine the first and second positions of the shaft, each piston being connected to a corresponding block.

* * * * *